US006588171B2

(12) United States Patent
Pryor et al.

(10) Patent No.: US 6,588,171 B2
(45) Date of Patent: Jul. 8, 2003

(54) CELLULAR-CORE STRUCTURAL PANEL, AND BUILDING STRUCTURE INCORPORATING SAME

(75) Inventors: Jerry C. Pryor, Orangeburg, SC (US); Howard A. Kuhn, Orangeburg, SC (US)

(73) Assignee: Scienda, LLC, Orangeburg, SC (US)

( * ) Notice: Subject to any disclaimer, the term of this patent is extended or adjusted under 35 U.S.C. 154(b) by 70 days.

(21) Appl. No.: 09/726,237

(22) Filed: Nov. 29, 2000

(65) Prior Publication Data

US 2002/0062611 A1 May 30, 2002

(51) Int. Cl.[7] ..... E04C 2/34

(52) U.S. Cl. ..... 52/793.1; 52/783.1; 52/800.1; 52/800.11; 52/269; 52/281

(58) Field of Search ..... 52/783.1, 793.1, 52/798.1, 799.1, 800.1, 800.11, 802.1, 802.11, 91.3, 92.2, 93.1, 261, 269, 270, 281

(56) References Cited

U.S. PATENT DOCUMENTS

| | | | |
|---|---|---|---|
| 1,925,769 | A | 9/1933 | McAvoy et al. |
| 2,299,614 | A | 10/1942 | Deutsch |
| 2,849,758 | A | 9/1958 | Plumley et al. |
| 2,863,185 | A | 12/1958 | Riedi |
| 2,893,076 | A | 7/1959 | Herts |
| 2,999,278 | A | 9/1961 | Spencer et al. |
| 3,110,131 | A | 11/1963 | Jeffress |
| 3,123,908 | A | 3/1964 | Boller |
| 3,203,145 | A | 8/1965 | Raynes |
| 3,235,920 | A | 2/1966 | Davis |
| 3,302,361 | A | 2/1967 | Oudheusden, Jr. et al. |
| 3,310,917 | A | 3/1967 | Simon |
| 3,323,797 | A | 6/1967 | Horton, Jr. |
| 3,339,329 | A | 9/1967 | Berg |
| 3,341,999 | A | 9/1967 | Berg |

(List continued on next page.)

FOREIGN PATENT DOCUMENTS

| | | |
|---|---|---|
| DE | 3149967 A1 | 7/1983 |
| FR | 1.300.597 | 6/1962 |
| FR | 2 628 135 A1 | 9/1989 |
| FR | 2 686 925 A1 | 8/1993 |

*Primary Examiner*—Carl D. Friedman
*Assistant Examiner*—Jennifer I. Thissell
(74) *Attorney, Agent, or Firm*—Alston & Bird LLP

(57) ABSTRACT

A structural panel for building structures such as residential houses or the like comprises a honeycomb or other cellular core sandwiched between two metal face sheets and surrounded by a metal frame. Frame members of the frame form mechanical interlocking connections with the face sheets of the panel. Side frame members of the panel define interlocking protrusions and channels for making interlocking joints between panels. A building structure employing the panels for forming floor and roofs includes brackets that extend into a gap between the side frame members of the panel at the panel joints and attach to the side frame members. The brackets are used for attaching the panels to other parts of the structure.

37 Claims, 10 Drawing Sheets

U.S. PATENT DOCUMENTS 3,434,262 A 3/1969 Lawrence
3,470,058 A 9/1969 Heffner
3,529,389 A * 9/1970 Wilkins ..... 52/793.1
3,529,394 A 9/1970 Wilkins
3,556,917 A 1/1971 Eakin et al.
3,676,279 A 7/1972 Beaver
3,769,767 A * 11/1973 Scott ..... 52/145
4,014,143 A 3/1977 Purcell
4,045,267 A 8/1977 Davis et al.
4,069,636 A 1/1978 Kessler
4,076,877 A 2/1978 Tanzen
4,125,977 A 11/1978 Michlovic
4,186,535 A 2/1980 Morton
4,201,020 A * 5/1980 Saunders
4,249,976 A 2/1981 Hudson
4,272,933 A 6/1981 Lopes
4,294,055 A 10/1981 Andresen
4,297,154 A 10/1981 Keller
4,404,889 A 9/1983 Miguel
4,439,969 A 4/1984 Bartlett
4,455,803 A 6/1984 Kornberger
4,599,841 A 7/1986 Haid
4,603,531 A 8/1986 Nash
4,680,902 A 7/1987 Stefnik et al.
4,738,067 A * 4/1988 Froseth ..... 52/478
4,803,108 A 2/1989 Leuchten et al.
4,833,854 A 5/1989 Paul
4,931,340 A 6/1990 Baba et al.
4,937,125 A 6/1990 Sanmartin et al.
4,972,635 A 11/1990 Wageman
4,973,506 A 11/1990 Bauer et al.
4,981,735 A 1/1991 Rickson
5,014,476 A 5/1991 Leslie et al.
5,052,164 A 10/1991 Sandow
5,058,352 A 10/1991 Loiselle et al.
5,062,250 A 11/1991 Buzzella
5,083,410 A 1/1992 Watson
5,085,023 A 2/1992 Duffy
5,197,256 A 3/1993 Martin
5,228,252 A 7/1993 Nehls
5,357,722 A 10/1994 Kessler
5,377,470 A 1/1995 Hebinck
5,390,468 A 2/1995 Probst
5,442,890 A 8/1995 Fligg
5,545,458 A 8/1996 Fukushima et al.
5,667,867 A 9/1997 Meier et al.
5,738,924 A 4/1998 Sing
5,804,030 A 9/1998 Jaegers et al.
5,839,848 A 11/1998 Sahramaa
5,899,037 A 5/1999 Josey
5,992,112 A 11/1999 Josey
6,023,898 A 2/2000 Josey
6,405,509 B1 * 6/2002 Razl ..... 52/800.12

* cited by examiner

CELLULAR-CORE STRUCTURAL PANEL, AND BUILDING STRUCTURE INCORPORATING SAME

FIELD OF THE INVENTION

The present invention relates to structural panels having a cellular core sandwiched between metal face sheets and surrounded by a frame, and to building structures that incorporate such panels.

BACKGROUND OF THE INVENTION

The vast majority of residential building structures in the United States are currently constructed from a wooden frame composed of many pieces of lumber nailed to one another. This type of construction, often referred to as "stick" construction, is currently favored in part because of the ready availability of lumber, but its popularity also has to do with a lack of practical alternatives. The widespread use of stick construction exists despite known disadvantages of stick construction in comparison with alternative types of construction that have been developed. For instance, steel-frame structures, which are increasingly being used in commercial and in some residential structures, have a much greater strength potential than wood-frame structures, are not susceptible to rot or insect damage, and have a lower material cost than wood-frame structures.

Even though these advantages of steel-frame construction are known, the construction industry, particularly in residential construction, has not been quick to switch to steel-frame construction. The industry's resistance to change is due in large part to a lack of skilled workers who have experience in steel-frame construction. The resistance is also due, however, to the high labor cost that is incurred in assembling a steel-frame structure. Conventional steel-frame structures are assembled by using a very large number of screws for fixing the steel framing members to one another. The process of inserting screws is much slower than nailing, and so it typically takes considerably longer to assemble a traditional steel frame than to assemble a wood frame.

The present invention relates to building materials and structures representing alternatives to conventional stick construction. Various alternative building materials and techniques have been proposed in the prior art. For instance, many types of building panels having a cellular core and metal face sheets have been proposed for use in the construction of various types of building structures. To date, however, the widespread use of such panels for constructing structures such as residential houses has not occurred. This is at least partly because of the difficulty of attaching the panels to one another and to other parts of the structure. The panel-to-panel and panel-to-structure attachments desirably should avoid penetrating the face sheets with fasteners, since penetrations of the face sheets in the region of the core can allow water to infiltrate the core.

SUMMARY OF THE INVENTION

The present invention seeks to improve upon traditional stick construction and to overcome the above-noted and other problems associated with constructing building structures from steel frames and/or cellular-core panels, by providing a panel and a building structure that facilitate assembly of the structure in a relatively simple manner without requiring a very large number of screws or other fasteners. The panel and structure also can achieve a higher strength than conventional wood-frame structures.

A panel in accordance with one embodiment of the invention comprises a core of cellular material, such as a honeycomb material, having a metal face sheet bonded to each of the opposite faces of the core. A side frame member is attached between the longitudinal edges of the face sheets along each of the two longitudinal edges of the core. Each of the side frame members defines a longitudinally extending protrusion and also defines a longitudinally extending recessed channel. The protrusion of each side frame member is aligned in the thickness direction of the panel with the channel of the other side frame member. Accordingly, two panels can be positioned with one side frame member of one panel opposing a side frame member of the other panel, and the protrusion of each side frame member can be inserted into the channel of the other side frame member, thus forming an interlocking panel joint between the panels. The interlocking side frame members prevent relative movement between the panels in at least the thickness direction. Preferably, the protrusions and channels extend along substantially the full longitudinal length of the panel. For convenience of manufacture, it is preferred to form the side frame members by roll-forming sheet metal.

In preferred embodiments of the invention, the side frame members and the face sheets of the panel form interlocking connections. This is preferably achieved by forming an edge of a side frame member and the adjacent edge of the face sheet such that at least one of the edges is hook-shaped and engages the other edge.

The panel preferably also includes end frame members that extend along the transversely extending edges of the core and are affixed between the ends of the side frame members to form a frame enclosing the core. The end frame members can also form interlocking connections with at least one of the face sheets. Preferably, each end frame member defines an outwardly projecting flange that extends beyond the transverse edge of the core for attaching the panel to a structure. The panel can also include an additional reinforcing member that is attached between two of the frame members and divides the core into two separate portions. The end frame and reinforcing members advantageously comprise roll-formed sheet metal members.

In one embodiment, the panel comprises a roof panel for a roof of a building, and one face sheet forms an upper surface of the roof and has a configuration and appearance for simulating a conventional type of roofing material. The upper face sheet can be configured, for example, to simulate the appearance of shingles. Alternatively, the upper face sheet can have upstanding ridge-shaped portions for simulating standing seams such as are present on conventional metal roofs. The panel in this embodiment includes at least one ridge-shaped portion that defines a hollow cavity between the face sheet and the core. Preferably, the cavity of the ridge-shaped portion is filled with adhesive, and the adhesive also is disposed between the entire face of the core and the face sheet for bonding the face sheet to the core. By filling the cavity of the ridge-shaped portion with adhesive, the continuous adhesive layer between the face sheet and the core is not interrupted at the ridge-shaped portion of the face sheet.

In a preferred embodiment of the invention, the protrusions of the side frame members are longer in a transverse direction of the panel than a depth of the recessed channels in the transverse direction. Accordingly, when two panels are joined at their respective side frame members with the protrusion of one side frame member fully inserted into the channel of the other side frame member, a gap exists between opposing portions of the side frame members. A portion of a bracket can be inserted into this gap and affixed to the side frame member of one of the panels, and another portion of the bracket that projects out from the panel joint can be affixed to another part of a building structure, thereby attaching the panel to the structure. Such brackets can be used for attaching roof panels to walls and for attaching upper ends of panels to each other and to a ridge member at a ridge of the roof. The brackets thus enable the panels to be attached to the structure without penetrating the face sheets of the panels with fasteners.

A building structure in accordance with one preferred embodiment of the invention has a roof constructed of a plurality of panels oriented such that at least one interlocking panel joint between adjacent panels runs from an outer one of the walls toward a ridge of the roof. A bracket having a plate portion extends into a gap defined between the side frame members forming the at least one interlocking panel joint, and the plate portion of the bracket is attached to one of the side frame members at the panel joint. Another portion of the bracket is attached to another part of the building structure.

Preferably, each panel of the roof runs in a continuous single span from a lower end of the panel adjacent one of the outer walls to an upper end of the panel adjacent the ridge of the roof, and the upper ends of the panels on one side of the ridge and the upper ends of the panels on an opposite side of the ridge are affixed to at least one vertical tension-bearing member that is anchored to the foundation to bear upwardly acting forces exerted on the panels of the roof. The vertical tension-bearing member can comprise an interior load-bearing wall or a series of vertical columns spaced apart beneath the roof ridge. The vertical tension-bearing member preferably is affixed to a ridge member that extends a length of the ridge and is connected to the upper end of each panel of the roof. The panels are connected to the ridge member by the brackets that project from the panel joints.

The roof panels at their lower ends adjacent an outer wall are attached to the outer wall by further brackets that attach to the side frame members in the gaps between adjacent panels. Each bracket has a base portion defining at least one flange portion that is affixed to the wall, and preferably has a pair of flange portions that receive the wall therebetween. The base portion is affixed to the wall by at least one fastener received through the flange portion(s) and the wall. Preferably, the fastener comprises a tube bolt. Tube bolts are preferred over conventional screws because a single tube bolt can provide a joint strength equivalent to a plurality of screws, thus reducing the number of fasteners that must be installed when assembling the structure.

In another embodiment of the invention, a floor of the building structure is constructed of a plurality of panels, each panel having one end attached to one wall and an opposite end attached to an opposite wall of the structure. A floor panel support bracket is affixed to one wall of the building structure so as to extend along the ends of a plurality of adjacent panels, and the ends of the panels are affixed to the floor panel support bracket. The floor can be an upper-story floor of a multi-storied building, the floor panel support bracket bearing loads exerted on the floor. It is preferred that the floor panel support bracket be affixed to the wall by a plurality of tube bolts.

Preferably, the end of each panel that is affixed to the floor panel support bracket defines an outwardly projecting flange that is substantially coplanar with an upper one of the face sheets of the panel, and the flange of each panel rests upon and is affixed to the floor panel support bracket. Alternatively, the lower surface of the panel can rest upon and be affixed to a ledge portion of a floor panel support bracket.

In accordance with yet another aspect of the invention, the walls of the structure comprise a plurality of roll-formed sheet metal members including a plurality of vertical members connected to a plurality of horizontal members, and connections between members are formed by a collar formed on one member and a hole formed through another member, the collar being received through the hole and being bent onto the other member so as to fasten the members together. The walls can be formed in sections that are prefabricated and transported to a job site, and the wall sections can be attached to one another at the job site to form the basic frame of the building. The attachment of the frame sections to one another can be made by tube bolts that are inserted through preformed holes formed in adjoining members of the wall sections.

The invention thus provides a panel and building structure that can be easily and rapidly assembled at a job site. Because many of the components of the structure can be prefabricated in the factory, the flatness, squareness, and dimensional accuracy of the components can be closely controlled, thus facilitating assembly of a structure that is dimensionally accurate, square, and plumb. The building structure of the invention also has high strength, and thus can provide significant advantages over stick-built structures, particularly in terms of resistance to high wind.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
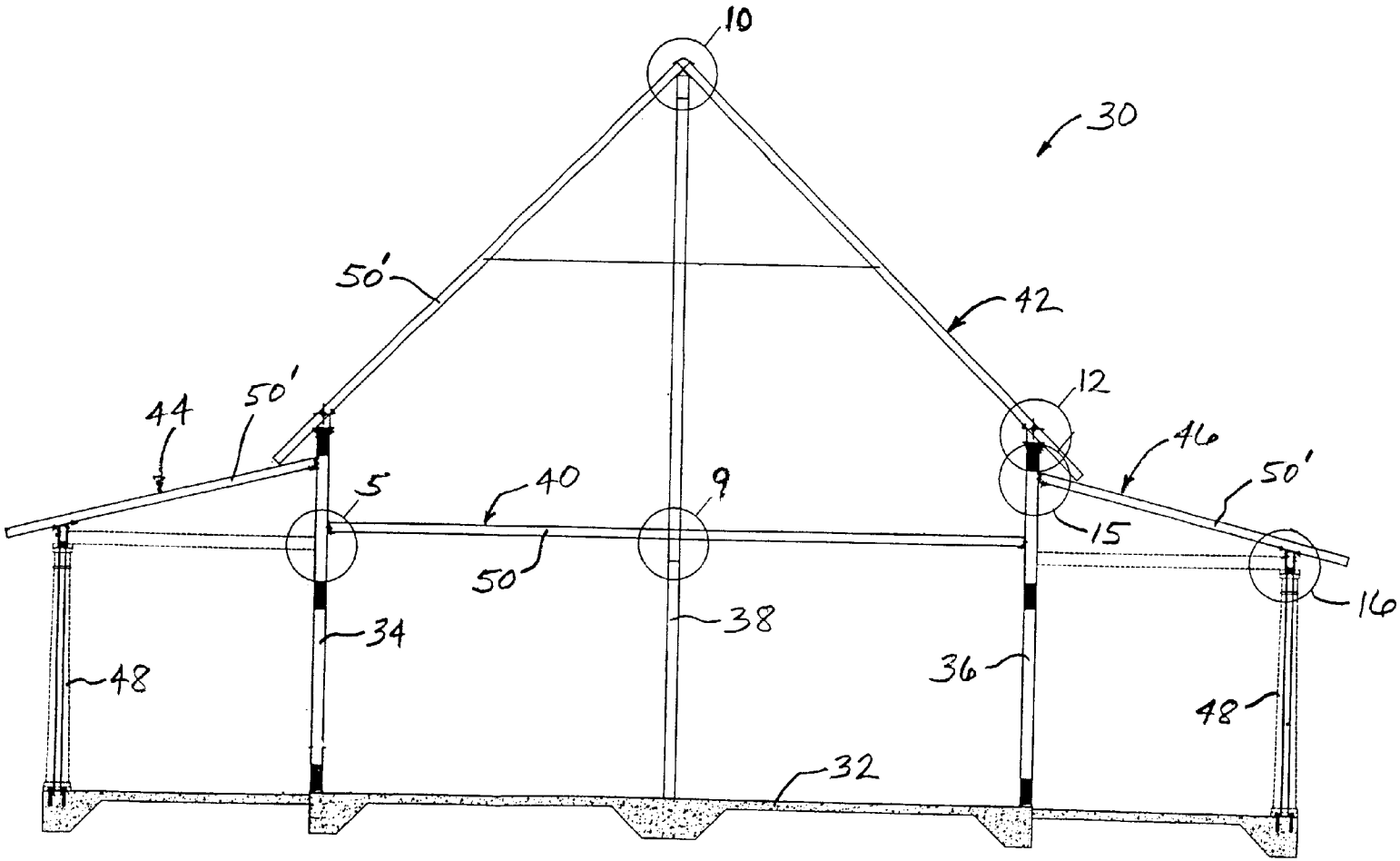
FIG. 1 is a schematic front view of a building structure in accordance with a preferred embodiment of the invention.

FIG. 1 depicts a building structure 30 in accordance with one preferred embodiment of the invention. The building structure 30 includes a foundation 32 of concrete or the like. A plurality of walls including a first outside wall 34 and an opposite second outside wall 36 are erected upon and anchored to the foundation 32. It will be understood that generally there would also be at least two additional outside walls (not shown) connected with the walls 34, 36 to form a closed outside wall perimeter. The outside walls comprise load-bearing walls. In addition, the structure 30 generally would include internal walls, of which one such internal wall 38 is shown, for subdividing the space bounded by the outside wall perimeter into rooms. The internal wall 38 is a load-bearing wall; other internal walls (not shown) may be load-bearing or non-load-bearing, depending on the particular structure.

The structure 30 has two stories, an upper floor 40 dividing the lower story from the upper story. The upper floor 40 is affixed to and supported by the load-bearing walls 34, 36, 38. In the illustrated structure, the floor of the lower story is formed by the foundation 32. However, the invention is also applicable to structures in which a basement or crawl space may exist under the lower story, in which case a lower floor may be affixed to and supported by load-bearing walls, similar to the upper floor 40.

The structure 30 has a roof 42 that is supported by the load-bearing walls 34, 36, 38. The structure also has a first side porch roof 44 and a second side porch roof 46 on opposite sides of the structure. Vertical support columns 48 provide support to the porch roofs at their outer ends.

Figure 2:
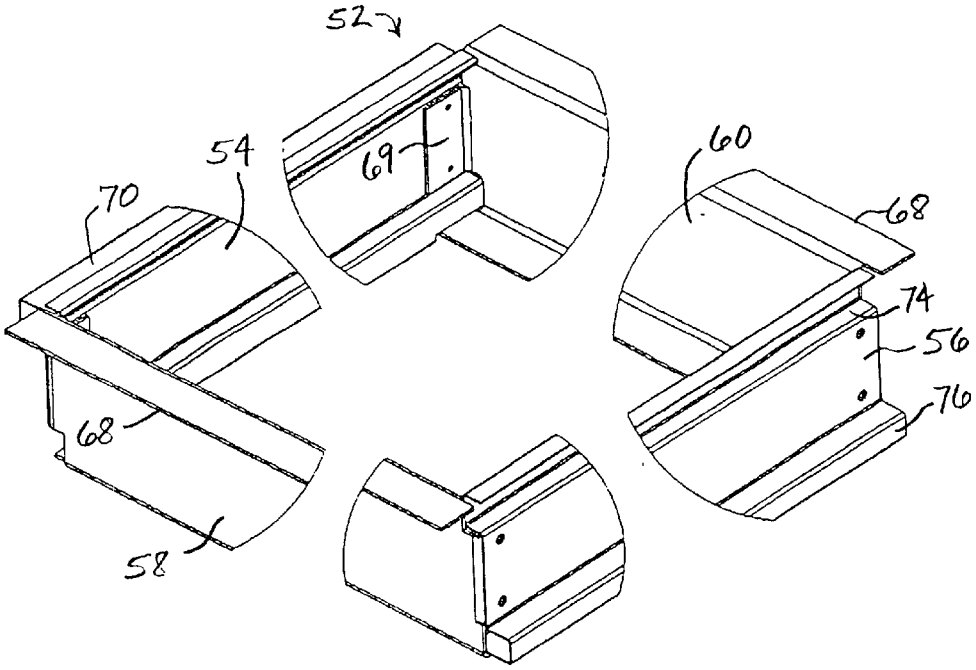
FIG. 2 is a perspective view of a frame of a structural panel in accordance with a preferred embodiment of the invention.
Figure 3:
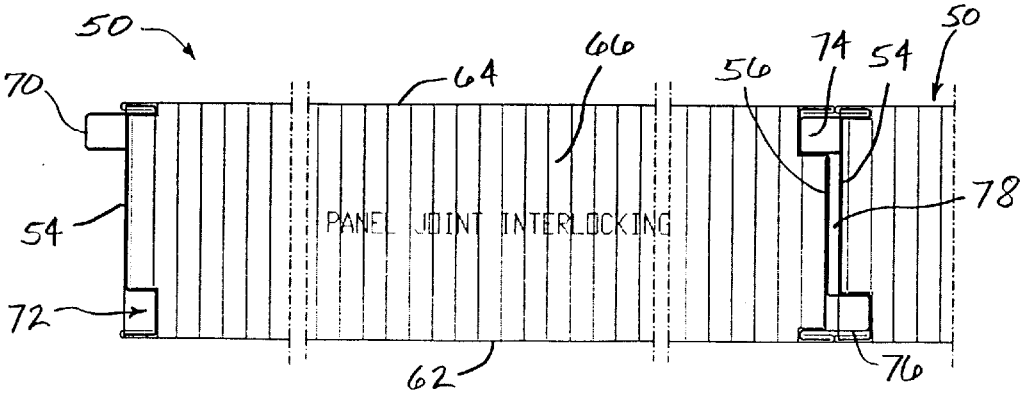
FIG. 3 is a schematic cross-sectional view, normal to a longitudinal axis, of a structural floor panel in accordance with the invention, showing another floor panel forming an interlocking panel joint at one longitudinal edge of the panel.
Figure 4:
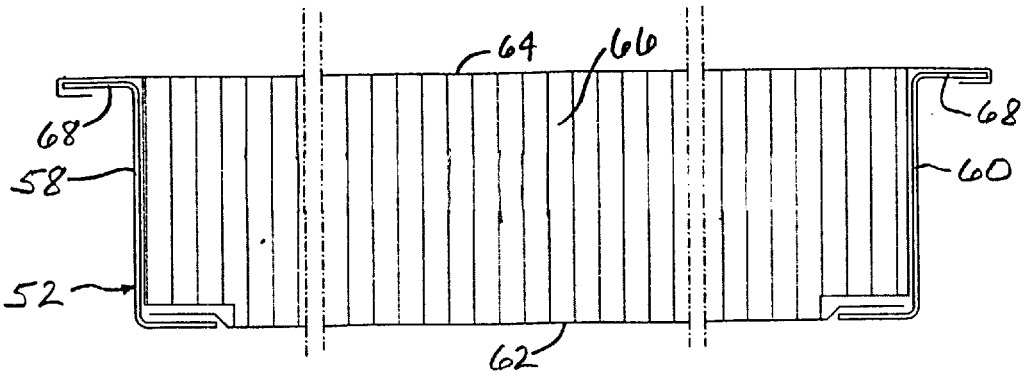
FIG. 4 is a schematic cross-sectional view, parallel to the longitudinal axis, of the floor panel of FIG. 3.

In accordance with the invention, the floor 40, the roof 42, and the porch roofs 44, 46 are formed from a plurality of cellular-core panels. A floor panel 50 is depicted in FIGS. 2 through 4. FIG. 2 shows a frame 52 of the floor panel, partially broken away to omit central portions of the frame members, since the frame members can be of various lengths for forming various sizes of panels. The frame 52 is formed from a pair of opposite side frame members 54 and 56, and a pair of opposite end frame members 58 and 60, joined end-to-end to form a rectangular frame. Each of the side and end frame members advantageously comprises a blank of sheet metal that is roll-formed to impart a substantially constant cross-sectional shape to the blank along a major part of the length of the frame member. As further described below, the particular shapes of the side and end frame members are designed to facilitate joining the panels together edge-to-edge and attaching the panels to other parts of the building structure 30.

FIGS. 3 and 4 depict cross-sectional views of a floor panel 50 on planes normal to each of the longitudinal and transverse axes of the panel, respectively. The side frame members 54, 56 extend lengthwise in a direction parallel to the longitudinal axis of the panel 50, and the end frame members 58, 60 extend lengthwise in a direction parallel to the transverse axis of the panel. The panel 50 includes a lower face sheet 62 and an upper face sheet 64 each comprising a metal sheet. The frame 52 and the face sheets 62, 64 preferably are formed of steel, and more preferably of galvanized steel. The face sheets 62, 64 are adhesively bonded to the opposite faces of a cellular core 66. Once cured, the honeycomb-core panel has a high degree of rigidity in bending about the longitudinal and transverse axes of the panel, and has a high crush strength in a thickness direction of the core 66. The core 66 preferably comprises a honeycomb material formed of kraft paper or the like impregnated with a heat-cured resin, preferably a phenolic resin. The resin preferably constitutes about 15 percent by weight of the honeycomb material. The cells of the honeycomb preferably are hexagonal with a dimension of about ⅝ inch measured across a cell from one side to an opposite side thereof. A suitable honeycomb material is available from Pactiv of Chicago, Ill. under the designation Hexacomb. Alternatively, other types of cellular materials could be used for the core 66, including other types of honeycomb material or, conceivably, rigid foam. A suitable adhesive for bonding the face sheets 62, 64 to the core 66 comprises a polyurethane type of adhesive, such as polyurethane adhesives available from Tailored Chemicals of Hickory, N.C. or from Reichhold Chemicals, Inc. of Durham, N.C. The adhesive bond between the face sheets and the core is achieved by pressing the face sheets against the core while heating the entire assembly to about 125° F.

The side and end frame members of the frame 52 closely surround the longitudinal and transverse edges of the core 66. The frame members are fixed in place by interlocking with the face sheets 62, 64. More particularly, each of the longitudinal edges of the side frame members 54 and 56 is turned outwardly away from the core 66 and is engaged in an inward-facing hook-shaped portion formed by the longitudinal edge of the adjacent face sheet 62, 64. The upper edges of the side frame members 54, 56 are similarly turned outwardly away from the core to form flange portions 68 that are engaged in inward-facing hook-shaped portions formed by the transverse edges of the upper face sheet 64. This mechanical interlocking of the face sheets to the frame members allows the joints between the face sheets and frame members to be free of adhesive bonding, thereby obviating the problem of providing an effective metal-to-metal adhesive bond having long-term integrity. The interlocking connections also provide smooth edges with a clean appearance. The lower edges of the end frame members 58, 60 are turned inwardly toward the core and overlap with the lower face sheet 62 at joggled portions thereof. Each of the end frame members has an end tab 69 (FIG. 2) at each end of the end frame member that is affixed in a suitable fashion, such as by screws or the like, to the adjacent side frame member 54, 56.

The side frame members 54, 56 are shaped in cross-section so that interlocking joints between panels 50 can be formed. More particularly, the side frame member 54 is formed to have a longitudinally extending protrusion 70 that extends substantially the entire length of the side frame member and is located proximate the upper face sheet 64. The side frame member 54 also is formed to have a longitudinally extending recessed channel 72 that extends substantially the entire length of the side frame member and is located proximate the lower face sheet 62. The opposite side frame member 56 has a longitudinally extending recessed channel 74 that is aligned in the thickness direction of the panel with the protrusion 70 of the side frame member 54, and a longitudinally extending protrusion 76 that is aligned in the thickness direction with the channel 72 of the side frame member 54. Accordingly, as shown in FIG. 3, one panel 50 can be positioned adjacent another panel 50 and the panels can be slid together such that the protrusions 70, 76 engage the respective channels 72, 74, thereby forming an interlocking panel joint. The interlocking engagement between the side frame members 54, 56 substantially prevents relative movement between the panels in at least the thickness direction of the panels.

Preferably, the protrusions 70, 76 and the channels 72, 74 are formed such that the protrusions are longer in the transverse direction (i.e., the left-to-right direction in FIG. 3) than the depth of the channels in the transverse direction. Thus, when the protrusions are fully engaged in their respective channels, there is a gap 78 between opposing central portions of the side frame members 54 and 56. This gap 78 enables a bracket to be inserted between the panels and attached to one of the side frame members, as further explained below, to facilitate attaching the panels to other parts of the building structure.

The panel 50 is fabricated by assembling the frame 52 to the lower face sheet 62, applying a suitable adhesive to the upper surface of the lower face sheet 62, placing the core 66 into the frame on top of the adhesive-covered lower face sheet 62, then applying adhesive to the lower surface of the upper face sheet 64 and placing the upper face sheet atop the core 66. The longitudinal edge of each face sheet that wraps about the adjacent edge of the side frame member 54, 56 and into the respective channel 72, 74 at this stage of assembly is perpendicular to the face sheet, and the transverse edges of the upper face sheet 64 are not yet wrapped about the upper edges of the end frame members 58, 60. The assembly is then subjected to compressive pressure in the thickness direction to urge the face sheets toward each other, and is simultaneously heated at a suitable temperature and for a sufficient time to cure the adhesive. Following the pressing and curing operation, the longitudinal edges of the face sheets are bent to wrap around the edges of the side frame members and into the channels 72, 74, and the transverse edges of the upper face sheet 64 are bent to wrap around the upper edges of the end frame members 58, 60.

Figure 5:
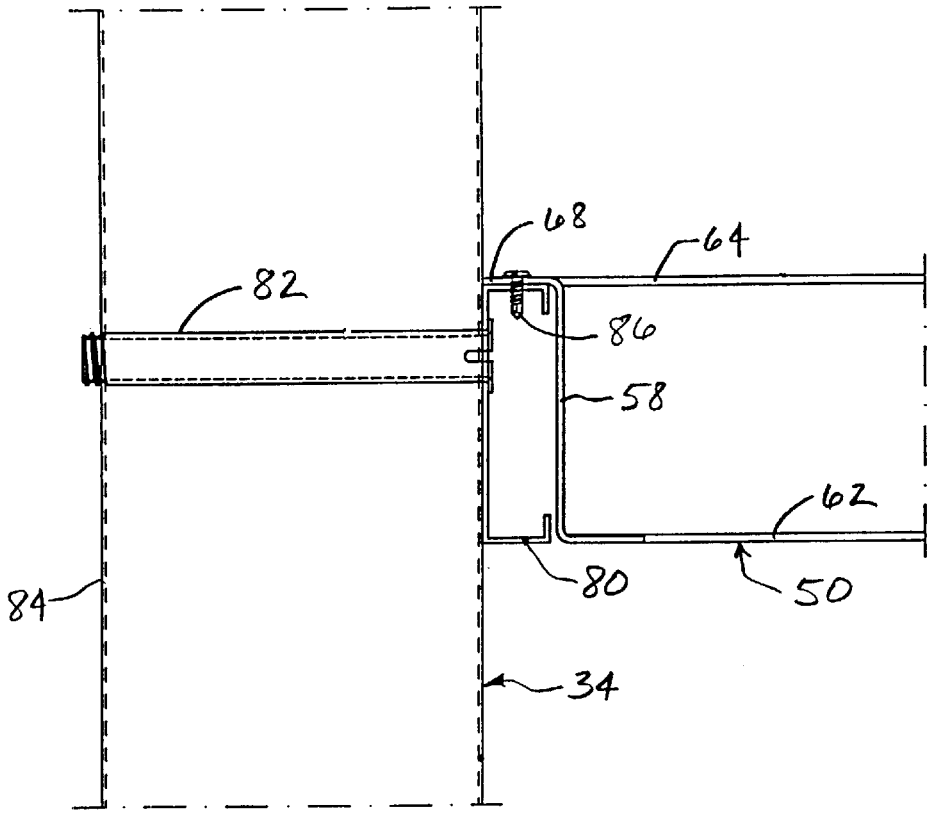
FIG. 5 is an enlarged cross-sectional view of one end of a floor panel attached to a panel support bracket that is affixed to a wall of the building structure.

As noted above, the upper floor 40 of the building structure 30 of FIG. 1 is constructed of a plurality of floor panels 50 that are laid side-by-side and joined together by interlocking panel joints between the longitudinal edges of the panels. With the possible exception of very long panels 50 (e.g., greater than about 25 feet or so), the panels 50 preferably are supported only at their ends by attaching the ends of the panels to load-bearing walls of the structure. For example, FIG. 5 shows the attachment of one end of a panel 50 to the outside wall 34 of the building structure. A panel support bracket 80 having a C-shaped cross-section is affixed to the wall 34 by suitable fasteners. The panel support bracket 80 has a length in the direction normal to the plane of the paper in FIG. 5 such that the bracket extends continuously along the ends of a plurality of side-by-side panels 50; thus, the length of the bracket 80 is generally equal to an integral multiple of the panel width. Preferably, a plurality of tube bolts 82, further described below, are passed through the bracket 80 at regularly spaced intervals along the length of the bracket and are screwed into preformed holes provided in the wall. Generally, the wall 34 includes a series of vertical studs 84, typically spaced 16 inches apart on center along the wall, and a hole for a tube bolt 82 is formed in every stud or in selected ones of the studs 84. For instance, the tube bolts 82 can be screwed through every third stud 84 such that the tube bolts are spaced about 4 feet apart on center. The panel support bracket 80 defines an upper flange portion upon which the flange 68 of the panel 50 rests. Suitable fasteners 86 are used to affix the panel flange 68 to the bracket 80. The fasteners 86 can be, for example, self-drilling screws. The panel support bracket 80 also defines a lower flange portion that is flush with the lower face sheet 62 of the panel 50.

Figure 6:
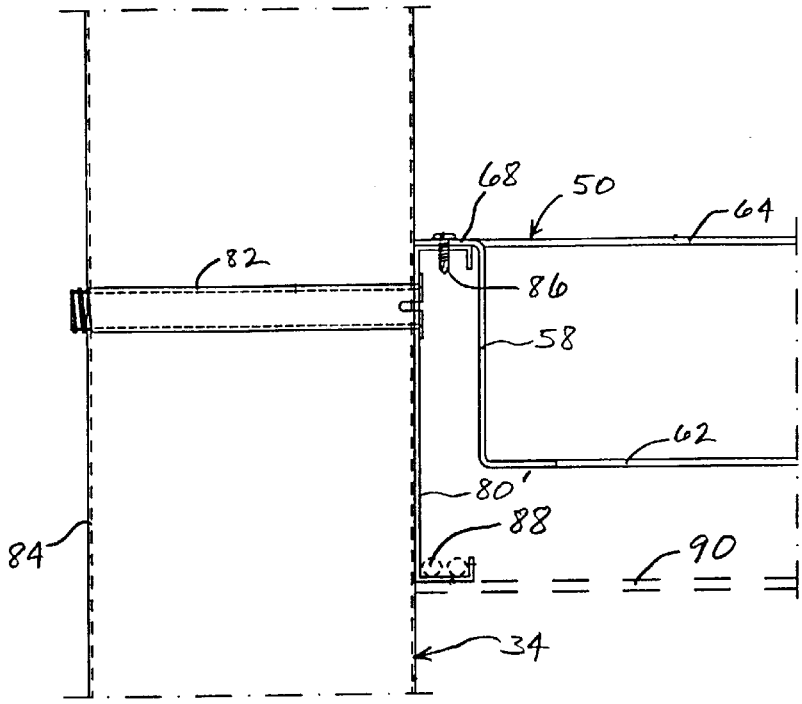
FIG. 6 is a view similar to FIG. 5, showing an alternative embodiment for attaching the floor panel to the wall.

FIG. 6 shows an alternative embodiment of the invention in which the panel support bracket 80' has a lower flange portion that is spaced vertically below the level of the lower face sheet 62. Electrical cables 88 may be laid in the channel thus formed by the bracket 80'. A drop ceiling 90 may be attached with the aid of the lower flange portion of the bracket 80', if desired.

Figure 7:
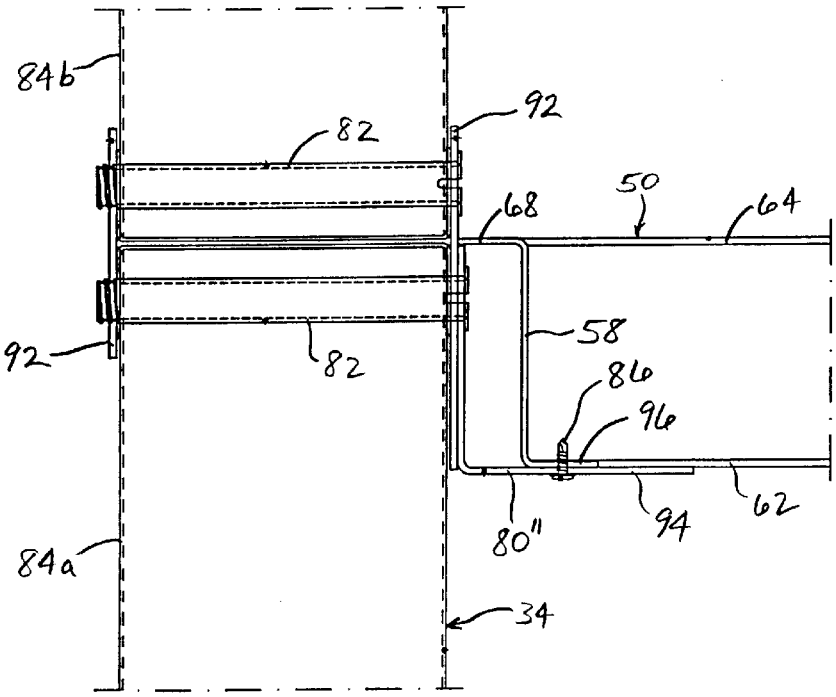
FIG. 7 is a view similar to FIG. 5, showing yet another alternative embodiment for attaching the floor panel to the wall.

The outside wall 34 in FIGS. 5 and 6 comprises a "balloon" structure wherein the vertical studs 84 extend continuously from the foundation 32 upward to the roof 42 (FIG. 1). FIG. 7 in contrast depicts an embodiment in which the outside wall 34 comprises a "platform" structure wherein one set of wall sections is formed for the lower story and a separate set of wall sections is formed for the upper story, and the upper wall sections are built upon the lower wall sections. Thus, the lower wall includes a plurality of vertical studs 84*a* and the upper wall includes a plurality of vertical studs 84*b* that are aligned with the lower studs. In this embodiment, a pair of metal plates 92 that span the juncture between a lower stud 84*a* and an upper stud 84*b* are disposed on the interior and exterior faces of the studs and tube bolts 82 are passed through the interior plate 92 and the studs and are screwed through the exterior plate 92. A lower one of the tube bolts 82 is also passed through an L-shaped panel support bracket 80" having a horizontal leg 94 for supporting the floor panels 50. The tube bolts 82 would be spaced at regular intervals along the length of the panel support bracket 80", such as about 4 feet apart on center. The floor panels 50 rest with their lower surfaces on the horizontal leg 94 of the panel support bracket and fasteners 86 are screwed through the leg 94 and into the inwardly turned lower flange 96 of the panel's end frame member 58.

Figure 8:
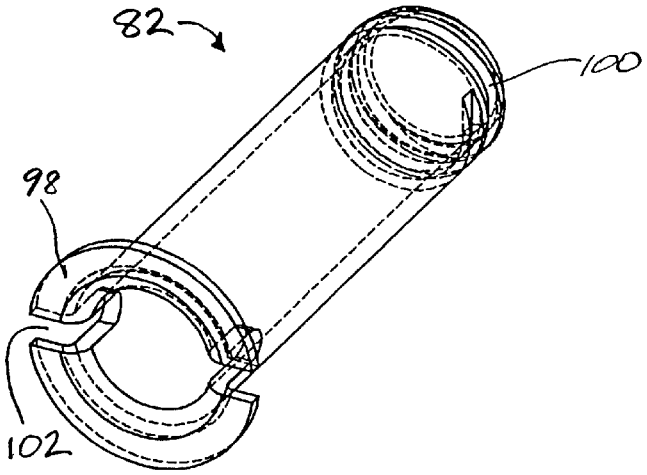
FIG. 8 is a perspective view of a tube bolt for attaching the floor panel support bracket to the wall.

FIG. 8 illustrates a tube bolt 82 in greater detail. The tube bolt comprises a hollow cylindrical metal body one end of which has a radially outwardly extending flange or head 98. The opposite end of the body defines a series of helical threads 100. The head end of the tube bolt has a slot 102 for receiving a driving tool (not shown). The tube bolt has a high degree of strength and thus a single tube bolt can replace a plurality of conventional screws.

Figure 9:
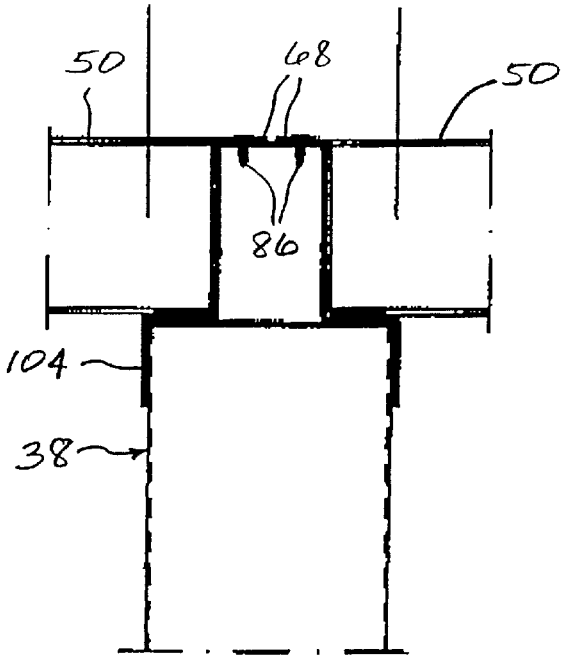
FIG. 9 is a cross-sectional view showing a connection between two floor panels and an internal load-bearing wall of the building structure.

Thus far, the attachment of the floor panels 50 to the outside wall 34 has been described. The opposite ends of the panels typically will be attached to an internal load-bearing wall, such as the wall 38 shown in FIG. 1. The connection between panels 50 and the internal wall 38 is depicted in FIG. 9. An elongate panel support bracket 104 having a hat-shaped cross-section is attached atop the upper end of the wall 38 and defines a pair of ledges on opposite sides of the wall 38. The floor panels 50 on either side of the wall 38 rest upon these ledges, and the outwardly projecting flange 68 of each panel rests upon the raised portion of the support bracket 104 and is attached to the bracket by fasteners 86.

As previously noted, the roof 42 of the building structure of FIG. 1 is constructed of a plurality of roof panels 50' that are generally similar to the floor panels 50 except as described below in connection with FIG. 11. The roof panels 50' interlock with one another in the same manner as the floor panels 50 and are oriented such that the interlocking panel joints between panels extend in the direction from the outside walls 34, 36 toward the ridge of the roof. Each roof panel 50' extends in a single continuous span from one of the outside walls to the ridge. The connections between the roof panels at the ridge are now described with reference to FIG. 10, which is a view looking along the running direction of the ridge and shows a pair of roof panels 50' on opposite sides of the ridge. A beam 106 of steel or the like runs along the length of the ridge and is attached to a series of spaced-apart vertical columns 108 that form part of the structure of the internal wall 38 (FIG. 1). Each column 108 preferably comprises a pair of members 110 of C-shaped cross-section having their open ends facing each other, the members 110 being affixed to each other by tube bolts (not shown) passed through both members. The lower ends of the columns 108 are anchored to the foundation 32 (FIG. 1) so that the columns can bear both compressive and tensile loads. The steel beam 106 is welded or otherwise rigidly affixed to a ridge member 112 having an angle cross-section conforming to the angle between the panels 50' on the opposite sides of the ridge; in the illustrated embodiment, the roof has a 12—12 pitch (i.e., it is sloped at 45° to the horizontal), and hence the ridge member 112 defines a right-angle section. The ridge member 112 extends the length of the ridge. The upper ends of the panels 50' on each side of the ridge rest upon the ridge member 112.

Figure 10:
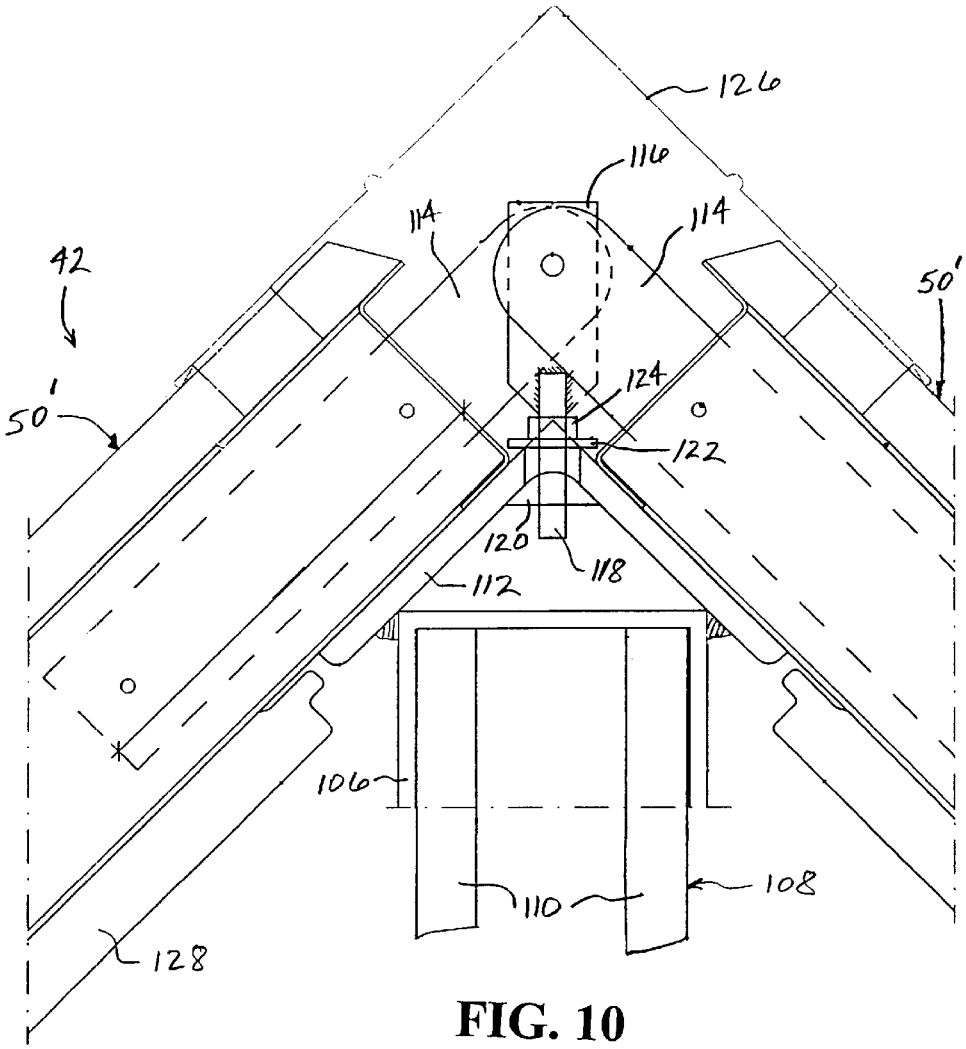
FIG. 10 is a cross-sectional view through the ridge of the roof of the building structure shown in FIG. 1, showing the connections between the roof panels and other structural members at the ridge.

Each interlocking joint between panels 50' on one side of the ridge is aligned with a panel joint on the other side of the ridge. A pair of aligned panels on the opposite sides of the ridge are connected to each other and to the ridge member 112 by a pair of panel ridge brackets 114. One of the panel ridge brackets 114 extends into the gap 78 between the side frame members 54, 56 (FIG. 3) of two adjoining panels 50' on one side of the ridge and is affixed to the side frame member of one of the panels. The other panel ridge bracket 114 on the other side of the ridge is similarly attached to the panel on that side. The brackets 114 have portions that project out from the panel joints generally in the longitudinal direction of the panels and overlappingly meet each other at the ridge of the roof. A screw (not shown) is passed through the overlapping portions of the brackets 114 and also through a steel plate 116 that is vertically oriented and has a depending portion that extends downward toward the ridge member 112. A threaded anchor bolt 118 is passed vertically upward through the ridge member 112 and a nut 120 is threaded onto the lower end of the anchor bolt. A washer 122 is placed over the portion of the anchor bolt 118 that projects up through the ridge member and then a nut 124 is threaded onto the upper end of the bolt. The upper end of the bolt 118 is welded to the plate 116 that is connected to the panel brackets 114. The connection arrangement shown in FIG. 10 is used at each panel joint along the ridge. Thus, the roof panels 50' are connected to the ridge member 112, and hence to the vertical columns 108. In this manner, the upper ends of the panels 50' are supported by the columns in both compression and in tension. Tensile loads on the columns 108 arise chiefly through aerodynamic loads on the roof panels 50' during high winds.

A ridge cap 126 running the length of the ridge covers the panel connection arrangements and is suitably attached to the roof panels. After installation of the roof panels, the lower surfaces of the panels are covered by a suitable material such as insulation board 128 or gypsum board.

Figure 11:
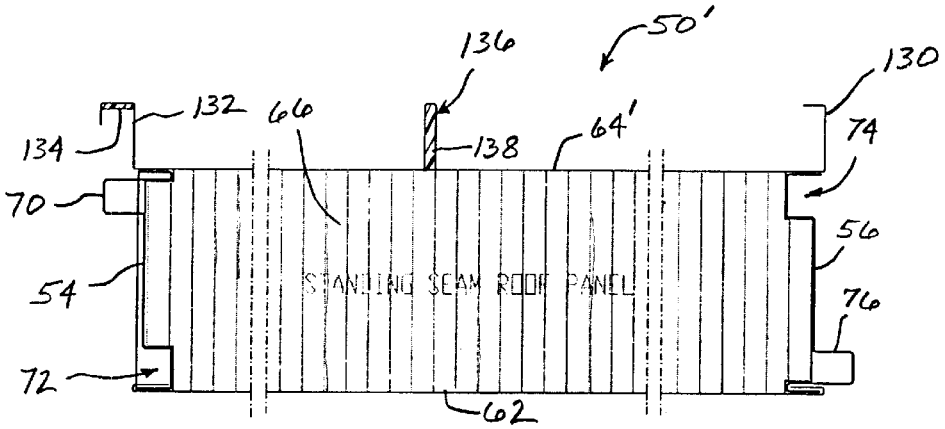
FIG. 11 is a schematic cross-sectional view of a roof panel in accordance with the invention, taken on a plane normal to the longitudinal axis of the panel.

A roof panel 50' is depicted in greater detail in FIG. 11. The roof panel 50' differs from the previously described floor panel 50 only with respect to the upper face sheet 64'. The upper face sheet 64' at its opposite longitudinal edges defines features for providing a connection between adjacent panels that discourages water from infiltrating into the panel joint. To this end, one of the longitudinal edges of the face sheet 64' is formed to define an upside-down L-shaped projection 130. The opposite longitudinal edge of the face sheet is formed to define an upside-down U-shaped projection 132. The horizontal portion of the U-shaped projection 132 is slightly wider than the horizontal portion of the L-shaped projection 130. When two roof panels 50' are joined along their longitudinal edges, the L-shaped projection 130 of one panel is covered by the U-shaped projection 132 of the adjacent panel. The two projections thus form a standing seam having a labyrinth type of passage that discourages water from entering the panel joint. If desired, a seal strip 134 of butyl rubber or the like can be provided between the U-shaped projection 132 and the L-shaped projection 130 for further assuring that water does not infiltrate the panel joint.

The roof panel 50' can also include one or more false standing seams 136 to simulate the appearance of a conventional metal roof, which typically has a relatively large number of relatively narrow metal sheets that are joined together by standing seams. In contrast, the roof panels 50' would generally be substantially wider than the metal roof sheets, for example, about 4 feet wide, and hence the false standing seams 136 give the appearance of a conventional metal roof. The false standing seam 136 is formed by deforming the upper face sheet 64' to form an upside-down U-shaped portion. Accordingly, a cavity is defined in the false standing seam 136. To maintain a continuous adhesive bond between the upper face sheet and the core 66, this cavity preferably is filled with adhesive 138, which is the same adhesive used for bonding the face sheet 64' to the core 66.

Figure 12:
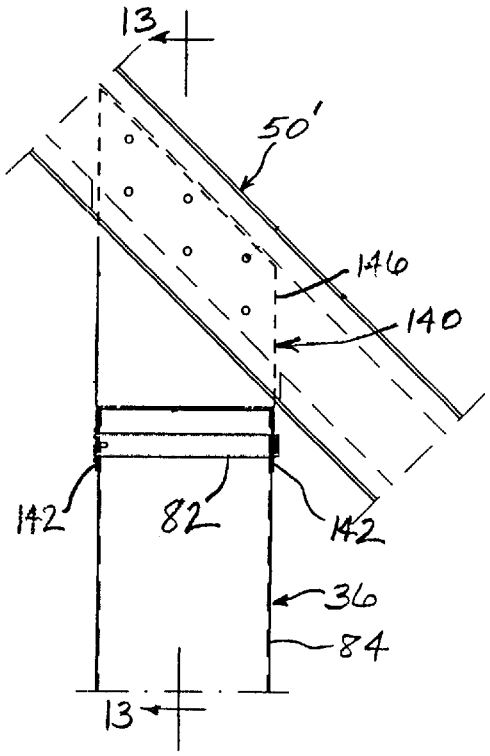
FIG. 12 is cross-sectional view showing a connection between a roof panel and an outer wall of the building structure.
Figure 13:
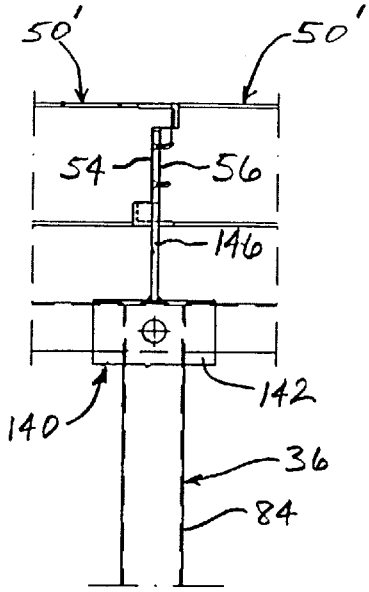
FIG. 13 is a cross-sectional view through the panel-to-wall connection, taken on a plane parallel to the wall.
Figure 14:
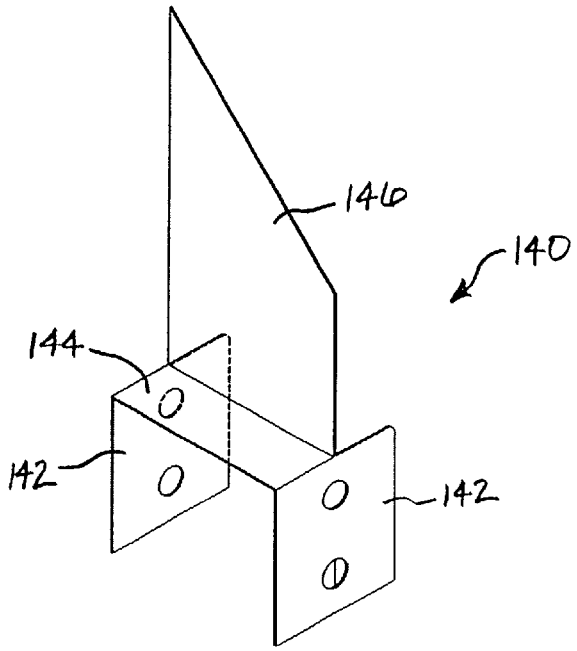
FIG. 14 is a perspective view of the panel bracket for attaching a roof panel to the wall.

The connections between the roof panels 50' and the outside walls 34, 36 are now described with reference to FIGS. 12 through 14. FIG. 12 is a cross-section on a vertical plane that is parallel to the longitudinal axes of the panels, and shows the roof panel connection to the wall 36, it being understood that the connection to the other wall 34 is the same. Affixed to the upper end of the wall 36 at each of the panel joints is a panel bracket 140. The panel bracket 140 has a base portion that defines at least one vertical flange portion 142 that is placed against an interior or exterior face of the wall 36 and is fastened to the wall by at least one tube bolt 82. In the illustrated embodiment, the bracket 140 has a pair of spaced flange portions 142 that are placed against both the interior and exterior faces of the wall, at least one tube bolt 142 being passed through both flange portions 142. FIG. 14 depicts a variation of the bracket 140 for receiving two tube bolts.

The bracket 140 has a horizontal base web 144 that sits atop the wall 36. A vertical plate portion 146 is either welded to or integrally formed with the base web 144. The plate portion 146 extends upward into the gap 78 (FIG. 3) between the side frame members 54, 56 of two adjoining roof panels 50' and is affixed to the side frame member 56 of one of the panels. To allow the plate portion 146 to extend upward into the gap between the side frame members, a lengthwise portion of the protrusion 76 of the side frame member 56 is cut away during manufacturing of the panel 50'.

Figure 15:
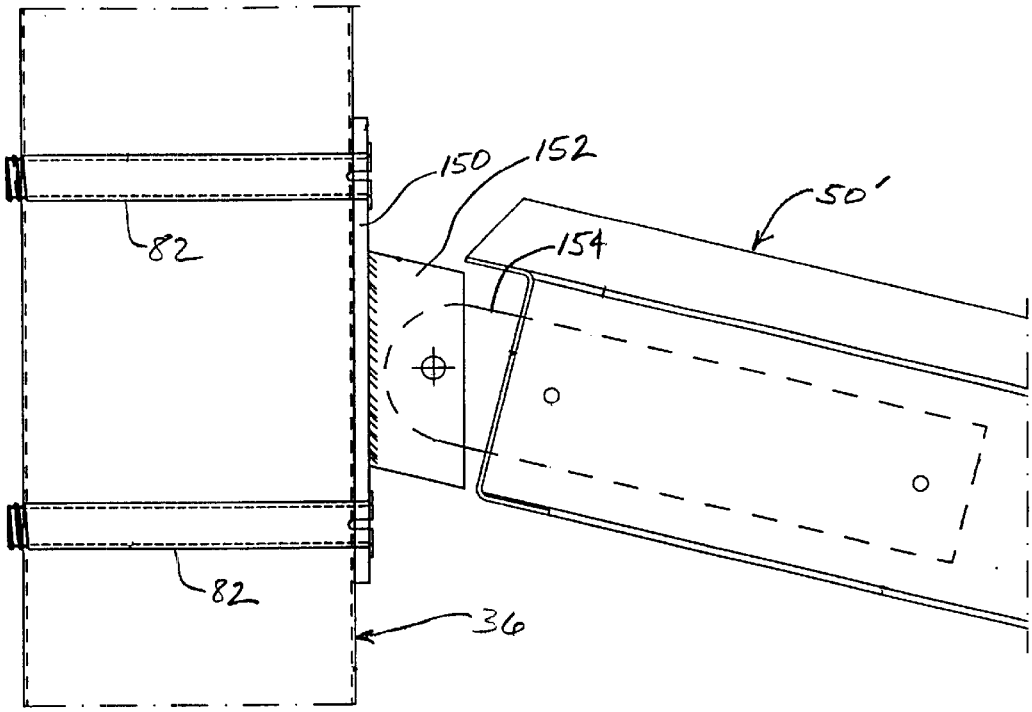
FIG. 15 is a cross-sectional view showing a connection between a porch roof panel and an outer wall of the building structure.

The building structure of FIG. 1 also has a pair of side porches covered by porch roofs 44, 46. FIG. 15 depicts the connection between the roof panels of the porch roof 46 and the outside wall 36, it being understood that the same type of connection is made between the porch roof 44 and the outside wall 34. A bracket 150 is affixed to the exterior face of the wall 36 by a pair of tube bolts 82. Welded to or integrally formed with the bracket 150 is a vertical tab portion 152 that projects outwardly from the wall 36. A bracket plate 154 is inserted into the gap of the panel joint and is affixed to the side frame member of one of the panels 50' forming the joint. A portion of the bracket plate 154 projects out from the panel joint toward the wall and is affixed to the tab portion 152 by a fastener (not shown).

Figure 16:
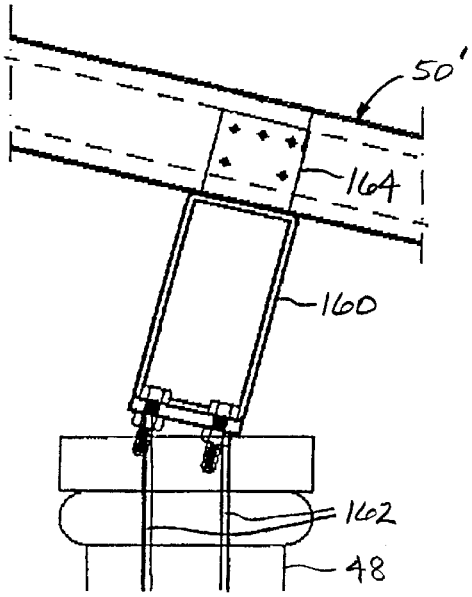
FIG. 16 is a cross-sectional view showing a connection between a porch roof panel and a vertical support column of the porch.

The outer ends of the roof panels 50' of the porch are supported by vertical columns 48. FIG. 16 depicts the connection between the panels and the columns. A steel beam 160 is supported atop the columns 48 and preferably is anchored to the foundation by tie rods 162 or the like that extend down through the column for supporting tensile loads. A bracket 164 is welded or otherwise rigidly affixed to the beam 160 and projects upwardly therefrom and into the gap between the side frame members of two panels at the panel joint therebetween. The bracket 164 is affixed to the side frame member of one of the panels. There is a bracket 164 at each panel joint.

Figure 17:
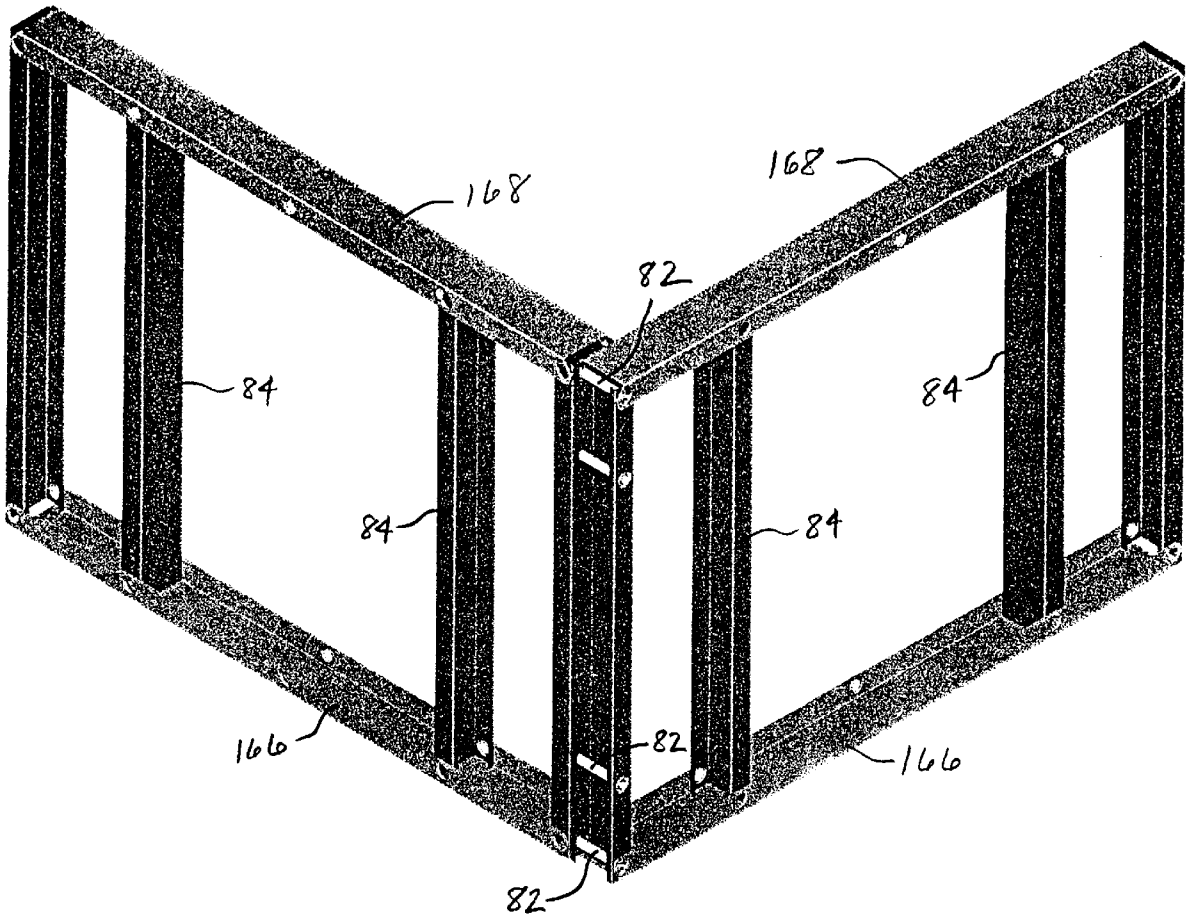
FIG. 17 is a perspective view showing two wall frame sections joined together by tube bolts at a corner of the building structure.
Figure 18:
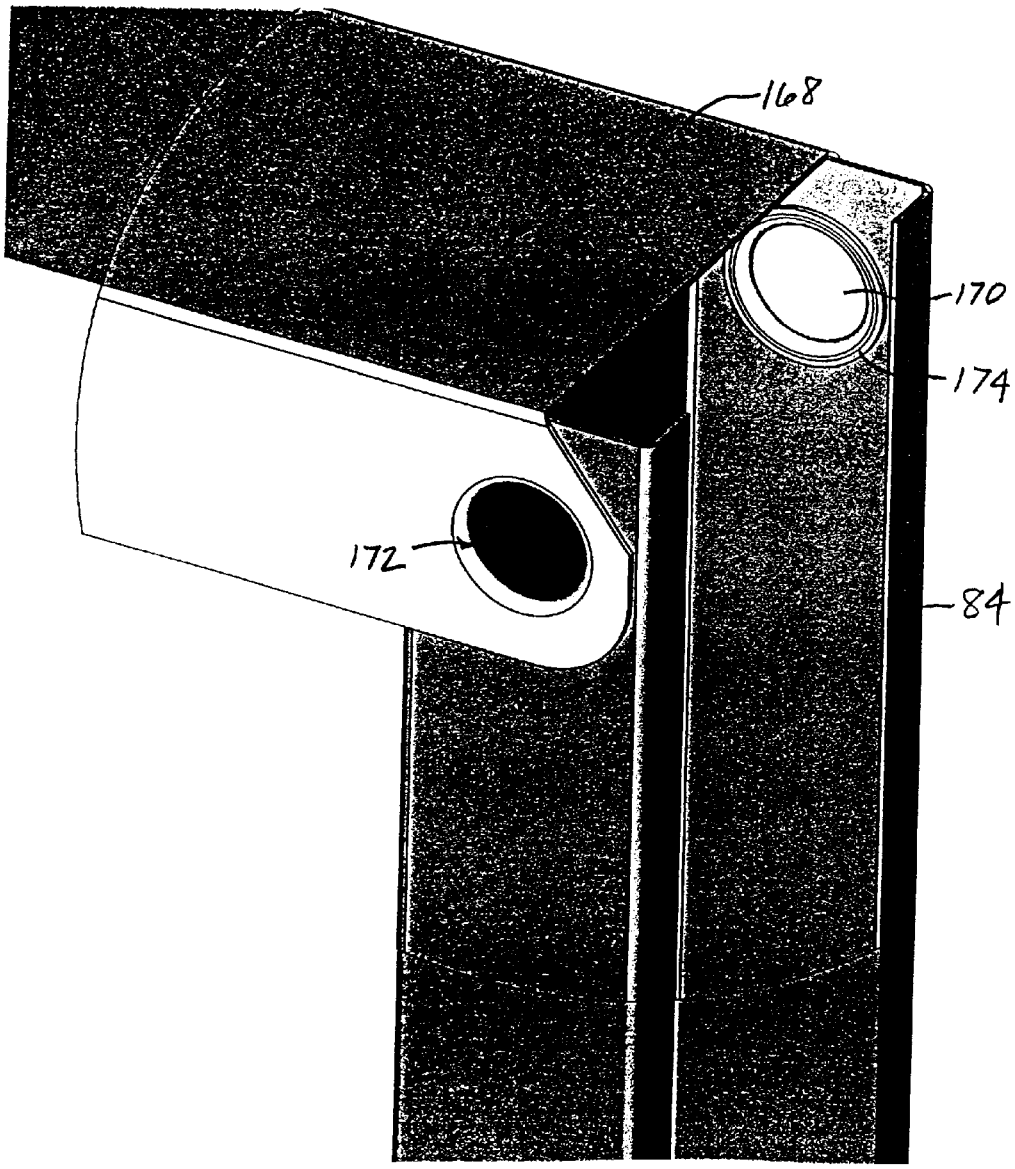
FIG. 18 is a perspective view of a connection between two wall frame members.

The walls of the building structure of FIG. 1 preferably are formed of steel frame members including a plurality of vertical members connected to a plurality of horizontal members. The frame members preferably are made of roll-formed sheet steel, which preferably is galvanized. FIG. 17 illustrates two wall frame sections of the building structure connected together at a corner of the building. Each wall frame section comprises a series of spaced vertical studs 84 connected to at least a bottom horizontal member 166 and a top horizontal member 168 at the opposite ends of the studs. Additional horizontal and/or diagonal bracing members (not shown) can also be included. The connections between the frame members of each wall section preferably are accomplished in accordance with U.S. Pat. No. 5,839,848, the entire disclosure of which is hereby incorporated herein by reference. FIG. 18 shows a connection in greater detail. The stud 84 comprises a C-shaped channel section having a pre-formed hole 170 formed through each of the opposing portions of the channel section. The horizontal member 168, also commonly known as a track or plate, comprises a U-shaped channel section having a pre-formed hole 172 formed through each of the opposing portions of the channel section, and having a pre-formed collar 174 surrounding each of the holes 172. The collars 174 extend through the holes 170 in the stud 84 and are deformed by a tool (not shown) so as to bend the collars onto the opposing portions of the stud 84, thereby affixing the two frame members 84, 168 to each other.

The wall frame sections preferably are prefabricated and are transported to the job site where they are attached together to form the walls of the building structure. The wall sections preferably are joined together by tube bolts 82 as shown in FIG. 17. The assembly of the building structure at the job site thus can be accomplished with relatively few fasteners and in a short amount of time, and does not require any specialized skills.

Many modifications and other embodiments of the invention will come to mind to one skilled in the art to which this invention pertains having the benefit of the teachings presented in the foregoing descriptions and the associated drawings. For example, a panel 50, 50' can have one or more reinforcing members connected between two opposite frame members of the panel frame 52 for increasing the bending stiffness of the panel about an axis perpendicular to the longitudinal direction of the reinforcing member. In this case, the core 66 would be divided by the reinforcing member(s) into two (or more) separate portions. Furthermore, although the panel 50, 50' has side frame members 54, 56 each of which defines both a protrusion and a channel, alternatively one side frame member could define only a protrusion and the other side frame member could define only a channel aligned with the protrusion. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A structural panel for building structures, comprising:

a cellular core having a pair of opposite substantially planar faces parallel to each other, and having edges extending between the faces generally perpendicular thereto, the edges including opposite first and second longitudinal edges, and opposite first and second transverse edges;

first and second metal face sheets each bonded to one face of the core such that the core is sandwiched between the face sheets, the face sheets each having opposite longitudinal edges; and first and second side frame members respectively extending along the first and second longitudinal edges of the core, each side frame member being connected between the longitudinal edges of the face sheets, each side frame member defining a recessed channel and a protrusion each extending longitudinally along a length of the side frame member, the channel of each side frame member being located in a thickness direction of the panel in alignment with the protrusion of the other side frame member;

wherein each side fame member comprises a metal sheet and has one longitudinal edge that interlockingly engages the longitudinal edge of one of the face sheets, and an opposite longitudinal edge that interlockingly engages the longitudinal edge of the other face sheet, each of the longitudinal edges of each side frame member and the corresponding longitudinal edge of the face sheet engaged therewith being formed as oppositely facing hook-shaped portions that are interlockingly engaged with each other.

2. The structural panel of claim 1, wherein the opposite longitudinal edge of each side frame member is turned outwardly away from the core and engages an inwardly turned hook-shaped portion formed by the longitudinal edge of the corresponding face sheet.

3. The structural panel of claim 1, further comprising first and second end frame members respectively extending along the transverse edges of the core, the side frame members and end frame members being joined end-to-end to form a rectangular frame enclosing the core.

4. The structural panel of claim 3, further comprising a reinforcing member connected to and extending between two of the frame members so as to divide the core into two separate portions.

5. The structural panel of claim 3, wherein the core comprises a honeycomb material.

6. The structural panel of claim 5, wherein the honeycomb material comprises paper impregnated with resin.

7. The structural panel of claim 3, wherein each end frame member comprises a metal sheet formed into a configuration having a substantially constant cross-sectional shape over a major part of a length of the end frame member.

8. A structural panel for building structures, comprising:

a cellular core having a pair of opposite substantially planar faces parallel to each other, and having edges extending between the faces generally perpendicular thereto, the edges including opposite first and second longitudinal edges, and opposite first and second transverse edges;

first and second metal face sheets each bonded to one face of the core such that the core is sandwiched between the face sheets, the face sheets each having opposite longitudinal edges;

first and second side frame members respectively extending along the first and second longitudinal edges of the core, each side frame member being connected between the longitudinal edges of the face sheets, each side frame member defining a recessed channel and a protrusion each extending longitudinally along a length of the side frame member, the channel of each side frame member being located in a thickness direction of the panel in alignment with the protrusion of the other side frame ember; and first and second end frame members respectively extending along the transverse edges of the core, the side frame members and end frame members being joined end-to-end to form a rectangular frame enclosing the core, wherein each end frame member comprises a metal sheet formed into a configuration having a substantially constant cross-sectional shape over a major part of a length of the end frame member, and wherein the major part of the length of each end frame member has a generally Z-shaped cross-sectional shape such that one edge of the metal sheet forms a first flange portion turned outwardly away from the core and an opposite edge of the metal sheet forms a second flange portion turned inwardly toward the core.

9. The structural panel of claim 8, wherein opposite transverse edges of the first face sheet overhang the corresponding transverse edges of the core, and wherein the first flange portion of one of the end frame members is connected to one of the overhanging transverse edges of the first face sheet and the first flange portion of the other end frame member is connected to the other overhanging transverse edge of the first face sheet.

10. The structural panel of claim 9, wherein the overhanging transverse edges of the first face sheet are each turned inwardly toward the core to form hook portions, and the first flange portions of the end frame members are interlockingly engaged in the hook portions.

11. The structural panel of claim 10, wherein the second flange portions of the end frame members form lap joints with the second face sheet.

12. A structural panel for building structures, comprising:

a cellular core having a pair of opposite substantially planar faces parallel to each other, and having edges extending between the faces generally perpendicular thereto, the edges including opposite first and second longitudinal edges, and opposite first and second transverse edges;

first and second metal face sheets each bonded to one face of the core such that the core is sandwiched between the face sheets, the face sheets each having opposite longitudinal edges; and first and second side frame members respectively extending along the first and second longitudinal edges of the core, each side frame member being connected between the longitudinal edges of the face sheets, each side frame member defining a recessed channel and a protrusion each extending longitudinally along a length of the side frame member, the channel of each side frame member being located in a thickness direction of the panel in alignment with the protrusion of the other side frame ember;

wherein the panel comprises a roof panel for a roof of a building, and wherein the first face sheet forms an upper surface of the roof and has a configuration and appearance for simulating a conventional type of roofing material, and wherein the first face sheet has upstanding ridge-shaped portions or simulating standing seams.

13. The structural panel of claim 12, wherein two of the ridge-shaped portions are formed by the two longitudinal edges of the first face sheet deformed upwardly away from the core.

14. The structural panel of claim 12, wherein at least one ridge-shaped portion defines a hollow cavity between the first face sheet and the core, and the cavity of the ridge-shaped portion is filled with adhesive, said adhesive also being disposed between the entire face of the core and the first face sheet for bonding the first face sheet to the core.

15. A structural panel for building structures, comprising:

a cellular core having a pair of opposite substantially planar faces parallel to each other, and having edges extending between the faces generally perpendicular thereto, the edges including opposite first and second longitudinal edges, and opposite first and second transverse edges;

first and second metal face sheets each bonded to one face of the core such that the core is sandwiched between the face sheets, the face sheets each having opposite longitudinal edges;

first and second side frame members respectively extending along the first and second longitudinal edges of the core, each side frame member being connected between the longitudinal edges of the face sheets, each side frame member defining a recessed channel and a protrusion each extending longitudinally along a length of the side frame member, the channel of each side frame member being located in a thickness direction of the panel in alignment with the protrusion of the other side frame member;

wherein the protrusions of the side frame members are longer in a transverse direction of the panel than a depth of the recessed channels in the transverse direction such that when two panels are joined at respective side frame members with the protrusion of one side frame member fully inserted into the channel of the other side frame member, a gap is created between opposing portions of the side frame members; and further comprising and in combination with a bracket formed separately from the panel for connecting the panel to further structure of a building, the bracket having a plate portion configured to extend into the gap between the opposing portion of one side frame member of the panel and the opposing portion of one side frame member of an adjoining panel and be affixed to the opposing portion of the side frame member of the panel.

16. The structural panel of claim 15, wherein the bracket further includes a base portion affixed to the plate portion and configured to be attached to the further structural member of the building when the panel and the further structural member are adjoined at an angle to each other.

17. The structural panel of claim 16, wherein the base portion of the bracket comprises a generally U-shaped structure having a base web joined perpendicular to the plate portion of the bracket, and a pair of attachment flanges joined to opposite edges of the base web and extending away from the plate portion.

18. A structural panel for building structures, comprising:

a cellular core having a pair of opposite substantially planar faces parallel to each other, and having edges extending between the faces generally perpendicular thereto, the edges including opposite first and second longitudinal edges;

first and second metal face sheets each bonded to one face of the core such that the core is sandwiched between the face sheets, the face sheets each having opposite longitudinal edges; and first and second side frame members respectively extending along the first and second longitudinal edges of the core, each side frame member comprising a metal sheet formed to have a substantially constant cross-sectional shape along a length of the side frame member and having opposite first and second longitudinal edges of the metal sheet that are interlockingly engaged with the longitudinal edges of the face sheets, wherein the first longitudinal edge of each side frame member and the longitudinal edge of the face sheet engaged therewith are formed as oppositely facing hook-shaped portions that are interlockingly engaged with each other.

19. The structural panel of claim 18, wherein the second longitudinal edge of each side frame member is turned outwardly away from the core and engages an inwardly turned hook-shaped portion formed by the longitudinal edge of the face sheet engaged therewith.

20. A building structure, comprising:

a foundation;

a plurality of walls erected upon the foundation;

a roof supported atop the walls; and at least one floor;

wherein at least one of the roof and floor comprises a plurality of load-bearing structural panels each comprising:

a cellular core having a pair of opposite substantially planar faces parallel to each other, and having edges extending between the faces generally perpendicular thereto, the edges including opposite first and second longitudinal edges, and opposite first and second transverse edges;

first and second metal face sheets each bonded to one face of the core such that the core is sandwiched between the face sheets, the face sheets each having opposite longitudinal edges generally aligned with the longitudinal edges of the core; and first and second side frame members respectively extending along the first and second longitudinal edges of the core, each side frame member comprising a metal sheet formed to have a substantially constant cross-section along a lengthwise portion of the side frame member and being connected between the longitudinal edges of the face sheets, one side frame member defining a recessed channel and the other side frame member defining a protrusion, the channel and the protrusion each extending longitudinally along said lengthwise portion of the respective side frame member, the channel being located in a thickness direction of the panel in alignment with the protrusion;

said plurality of the panels including at least one interlocking panel joint between two adjacent panels, the first side frame member of one of the panels being connected to the second side frame member of the other panel at the panel joint via engagement of the protrusion of one of the side frame members in the channel of the other side frame member.

21. The building structure of claim 20, wherein the roof is constructed from said plurality of panels oriented such that the at least one interlocking panel joint between adjacent panels runs from an outer one of the walls toward a ridge of the roof, and wherein a bracket having a plate portion extends into a gap defined between the first and second side frame members forming the at least one interlocking panel joint, the plate portion of the bracket being attached to one of the side frame members at the panel joint, and another portion of the bracket being attached to another portion of the building structure.

22. The building structure of claim 21, wherein the gap between side frame members at the panel joint is created by sizing the protrusion and channel of the side frame members such that the protrusion is longer in a transverse direction of the panel than a depth of the recessed channel in the transverse direction, whereby the gap is created between opposing portions of the side frame members.

23. The building structure of claim 21, wherein each panel of the roof runs in a continuous single span from a lower end of the panel adjacent one of the outer walls to an upper end of the panel adjacent the ridge of the roof, and wherein the upper ends of the panels on one side of the ridge and the upper ends of the panels on an opposite side of the ridge are affixed to at least one vertical tension-bearing member that is anchored to the foundation to bear upwardly acting forces exerted on the panels of the roof.

24. The building structure of claim 23, wherein the at least one vertical tension-bearing member is affixed to a ridge member that extends a length of the ridge and is connected to the upper end of each panel of the roof.

25. The building structure of claim 24, wherein each panel on each side of the ridge has one of the brackets affixed thereto, the brackets extending from the upper ends of the panels and being affixed to the ridge member.

26. The building structure of claim 25, wherein there are a plurality of the brackets affixed to panels on each side of the ridge and spaced apart along a length of the ridge with each bracket on one side of the ridge being affixed to one of the brackets on the opposite side of the ridge.

27. The building structure of claim 21, wherein the bracket at the at least one panel joint is attached to one side frame member of one of the panels forming the panel joint proximate a lower end of the panel and is also attached to one outer wall of the building structure.

28. The building structure of claim 27, wherein the bracket has a base portion defining a pair of spaced-apart flange portions for receiving an upper end of the wall therebetween, the base portion of the bracket being affixed to the wall by at least one fastener received through the flange portions and the wall.

29. The building structure of claim 27, wherein the bracket has a base portion defining at least one flange portion that is affixed to the wall by at least one tube bolt received through the at least one flange portion and the wall.

30. The building structure of claim 20, wherein the floor is constructed of the plurality of panels, each panel having one end of the panel attached to one wall and an opposite end of the panel attached to an opposite wall of the structure.

31. The building structure of claim 30, wherein a floor panel support bracket is affixed to one wall of the building structure so as to extend along the ends of a plurality of adjacent panels, the ends of the panels being affixed to the floor panel support bracket.

32. The building structure of claim 31, wherein the floor panel support bracket is affixed to the wall by a plurality of tube bolts.

33. The building structure of claim 31, wherein the end of each panel that is affixed to the floor panel support bracket defines an outwardly projecting flange that is substantially coplanar with an upper one of the face sheets of the panel, and the flange of each panel rests upon and is affixed to the floor panel support bracket.

34. A building structure, comprising:

a foundation;

a plurality of walls erected upon the foundation; and a roof supported atop the walls, the roof comprising a plurality of load-bearing structural panels each comprising a cellular core having a pair of opposite substantially planar faces parallel to each other and opposite first and second longitudinal edges extending between the faces, and first and second metal face sheets each bonded to one face of the core such that the core is sandwiched between the face sheets, the face sheets each having opposite longitudinal edges generally aligned with the longitudinal edges of the core, and wherein each panel of the roof runs in a continuous single span from a lower end of the panel adjacent one of the outer walls to an upper end of the panel adjacent the ridge of the roof, and wherein the upper ends of the panels on one side of the ridge and the upper ends of the panels on an opposite side of the ridge are affixed to at least one vertical tension-bearing member that is anchored to the foundation to bear upwardly acting forces exerted on the panels of the roof.

35. The building structure of claim 34, wherein each panel further comprises first and second side frame members respectively extending along the first and second longitudinal edges of the core, the side frame members being complementarily configured such that one of the side frame members of one panel and the other side frame member of an adjacent panel form an interlocking panel joint between the panels for substantially preventing relative movement between the panels in a thickness direction of the panels.

36. The building structure of claim 35, wherein the side frame members are configured such that there is a gap between opposing portions of the interlocking side frame members at the panel joint, and wherein each panel that forms a panel joint with another panel is affixed to another part of the structure by a bracket having a first portion affixed to the other part of the structure and a second portion that extends into the gap at the panel joint and is affixed to the side frame member of the panel.

37. The building structure of claim 34, wherein the walls of the structure comprise a plurality of roll-formed sheet metal members including a plurality of vertical members connected to a plurality of horizontal members, and wherein connections between members are formed by a collar formed on one member and a hole formed through another member, the collar being received through the hole and being bent onto the other member so as to fasten the members together.

* * * * *

UNITED STATES PATENT AND TRADEMARK OFFICE

CERTIFICATE OF CORRECTION

PATENT NO. : 6,588,171 B2
DATED : July 8, 2003
INVENTOR(S) : Pryor et al.

It is certified that error appears in the above-identified patent and that said Letters Patent is hereby corrected as shown below:

Column 12,
Line 56, “fame” should read -- frame --.

Column 13,
Line 40, “ember” should read -- member --.

Column 14,
Line 24, “ember” should read -- member --;
Line 30, “or” should read -- for --.

Column 15,
Line 7, after “to” insert -- a --.

Signed and Sealed this

Seventh Day of October, 2003

JAMES E. ROGAN
*Director of the United States Patent and Trademark Office*